US009141061B2

(12) United States Patent
Takaki

(10) Patent No.: US 9,141,061 B2
(45) Date of Patent: Sep. 22, 2015

(54) IMAGE FORMING APPARATUS

(71) Applicant: Konica Minolta, Inc., Tokyo (JP)

(72) Inventor: Kouichi Takaki, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 13/940,445

(22) Filed: Jul. 12, 2013

(65) Prior Publication Data

US 2014/0023386 A1 Jan. 23, 2014

(30) Foreign Application Priority Data

Jul. 20, 2012 (JP) ..... 2012-161548

(51) Int. Cl.
*G03G 15/00* (2006.01)

(52) U.S. Cl.
CPC ..... *G03G 15/5095* (2013.01); *G03G 15/5058* (2013.01)

(58) Field of Classification Search
USPC ..... 399/38, 78, 86
See application file for complete search history.

(56) References Cited

U.S. PATENT DOCUMENTS 6,839,078 B2 * 1/2005 Izumiya et al. ..... 347/249
7,130,097 B2 * 10/2006 Higashi et al. ..... 359/216.1
7,499,193 B2 * 3/2009 Nishikawa ..... 358/1.9
7,778,579 B2 * 8/2010 Ueda et al. ..... 399/301
8,121,526 B2 * 2/2012 Fukuyama et al. ..... 399/302
2008/0220347 A1 * 9/2008 Tomita et al. ..... 430/48
2009/0296174 A1 * 12/2009 Yasunaga ..... 358/518
2010/0141975 A1 * 6/2010 Takaki ..... 358/1.12
2010/0150590 A1 * 6/2010 Yoshino ..... 399/49

FOREIGN PATENT DOCUMENTS

JP 2011-022468 A 2/2011
JP 2011-100035 A 5/2011

* cited by examiner

*Primary Examiner* — Clayton E Laballe
*Assistant Examiner* — Warren K Fenwick
(74) *Attorney, Agent, or Firm* — Lucas & Mercanti, LLP

(57) ABSTRACT

Disclosed is an image forming apparatus includes: an image forming section, a control section, and a magnification factor adjusting section.

The control section employs an index signal based on a detected result of a light beam irradiation, for controlling an operation timing of the image forming section in the toner image area; and when forming the band-shaped toner image on the area between the toner image areas being adjacent to each other, while controlling the magnification factor adjusting section to implement an operation for adjusting the image magnification factors in parallel, the control section employs a timing signal, created otherwise without depending on the detected result of the light beam irradiation, for controlling the operation timing of the image forming section.

5 Claims, 3 Drawing Sheets

IMAGE FORMING APPARATUS

CROSS REFERENCE TO RELATED APPLICATION

This Application claims the priority of JP Patent Application No. 2012-161548 filed on Jul. 20, 2012, which application is incorporated herein by reference in its entirety.

BACKGROUND OF THE INVENTION

1. Field of the Invention

The present invention relates to controlling operations for forming a band-shaped toner image onto an intermediate area residing between two toner image areas which are adjacent to each other on a surface of an image bearing member provided in an image forming apparatus, while performing an image magnification factor adjusting operation in parallel.

2. Description of Related Art

In an image forming apparatus employing an electro-photographic method, a patch toner image or a band-shaped toner image may be formed on an area (paper interval area) provided between a toner image area (defined as an area where a toner image to be transferred onto a paper sheet is formed on the basis of image data) and a next toner image area, both of which are to be provided on a surface of an image bearing member, such as a photoreceptor drum, an intermediate transfer member, etc. Hereinafter, the controlling operation for forming the patch toner image and the band-shaped toner image is referred to as a controlling operation for forming a toner zone within the paper interval area, as its generic name.

In the image forming apparatus as above-mentioned, toner is employed for the image forming operation. Further, in order to prevent the toner from deterioration caused by the result of storing the toner within a developing device for a long time, there has been well-known such a technology that the band-shaped toner image is formed on the paper interval area of the surface of the image bearing member so as to positively consume the toner. For instance, Japanese Patent Application Laid-Open Publication 2011-22468 sets forth such the toner consuming technology as abovementioned. Further, other than the band-shaped toner image, sometimes, various kinds of patch toner images may be formed for the purpose of adjusting the image forming apparatus.

In addition to the abovementioned, in the image forming apparatus, a fixing section applies heat and pressure onto the toner image, transferred onto the paper sheet, so as to fix the toner image onto the paper sheet concerned. On this occasion, the paper sheet may be shrunk under the influence of the heat applied during the fixing operation. Concretely speaking, since the image formed on the first surface of the paper sheet is already shrunk due to the fixing process, and then, the other image is formed on the second surface of the paper sheet in a shrunk state, image magnification factors of obverse and reverse sides of the paper sheet may not coincide with each other. Accordingly, when performing a duplex printing for forming images on both sides of the paper sheet, it is necessary to apply fine-adjustment processing to both the image sizes (image magnification factors) of obverse and reverse sides of the paper sheet in advance, in order to improve the accuracy of the positional relationship between the images respectively formed on obverse and reverse sides of the paper sheet.

As the controlling operation for performing the fine-adjustment between the image magnification factors of obverse and reverse sides of the paper sheet, the method for adjusting the velocity of image forming process (driving speed of the photoreceptor drum or the intermediate transfer member), the other method for adjusting the rotational velocity, etc., are well-known. In a case that such the conventional method as abovementioned is employed, it takes same time to complete the adjustment, and accordingly, a waiting time necessary for completing the adjustment (adjustment time) has been established in the conventional image forming apparatus.

Further, since the waiting time is a certain time interval residing between the toner image area and the next toner image area on the surface of the image bearing member, the waiting time may possibly overlap with the other time interval for forming the patch toner image onto the paper interval area.

In other words, sometimes, the timing for adjusting the image magnification factor would overlap with the other timing for implementing the controlling operation for forming toner zone on the paper interval area. Accordingly, there has been such a technology that the patch toner image is formed on the paper interval area after the operations for adjusting the image magnification factors of obverse and reverse sides of the paper sheet has been completed. For instance, Japanese Patent Application Laid-Open Publication 2011-100035 sets forth the abovementioned technology.

SUMMARY OF THE INVENTION

As described in the foregoing, according to such the technology as above-mentioned, in which the patch toner image is formed on the paper interval area after the operations for adjusting the image magnification factors of obverse and reverse sides of the paper sheet has been completed, it is necessary to make the duration time of the paper interval area longer than ever. Owing to the above-mentioned, there has been arisen such a problem that the number of images to be outputted per unit time is reduced, namely, the productivity thereof is deteriorated.

In order to avoid such the deterioration of the productivity, it is necessary to operate each of the sections provided in the image forming apparatus at a high speed, and this arises other problems, such that the manufacturing cost of the image forming apparatus may be increased, and/or the improved processing capability may increase a processing burden of the electronic circuits, etc. On the other hand, it may be also considered that the patch toner image is formed, while the image magnification factors above-mentioned is adjusted in parallel, so as to shorten the duration time of the paper interval area and to improve the productivity.

The inventor of the present invention has intensively performed various kinds of experiments in regard to such the parallel implementation as above-mentioned. As a result, the following facts have been revealed, so far. Concretely speaking, in the image forming apparatus, the detected result of the laser beam scanned by the polygon mirror is employed as the timing signal serving as the index signal for determining the operation timing of each of the sections.

However, the index signal enters into an unstable state due to the operation for adjusting the image magnification factors. Further, in a case where the toner image, such as the bend-shaped toner image, the patch toner image or the like, is formed by employing such the unstable index signal as above-mentioned, the present inventor has confirmed occurrence of such the malfunction that, since the counting operation for controlling the shape and size of the toner image is not performed normally, the toner image concerned is not outputted, or the toner images concerned are continuously outputted without stopping.

Owing to the reasons described in the foregoing, it may be considered that it is quite difficult for the conventional image forming apparatus to implement the operation for forming toner image in mid-course of adjusting the image magnification factors in parallel.

To overcome the above-mentioned drawbacks in conventional image forming apparatus, it is one of objects of the present invention to provide an image forming apparatus, which makes it possible to normally perform controlling operations for adjusting the image magnification factors of obverse and reverse sides of the paper sheet and forming a toner zone onto the paper interval area in a short time.

According to an image forming apparatus reflecting an aspect of the present invention, the image forming apparatus comprises: an image forming section configured to perform operations for irradiating a light beam onto a surface of an image bearing member, forming a toner image corresponding to electrostatic potential changes caused by the light beam and transferring the toner image onto a paper sheet; a control section configured to control the image forming section, and a magnification factor adjusting section configured to adjust image magnification factors of obverse and reverse sides of the paper sheet; wherein the control section conducts controlling operations so as to form a band-shaped toner image on an area located between toner image areas, which reside on the surface of the image bearing member and are adjacent to each other, and the control section employs an index signal based on a detected result of a light beam irradiation, for controlling an operation timing of the image forming section in the toner image area; and wherein, when forming the band-shaped toner image on the area between the toner image areas being adjacent to each other, while controlling the magnification factor adjusting section to implement an operation for adjusting the image magnification factors in parallel, the control section employs a timing signal, created otherwise without depending on the detected result of the light beam irradiation, for controlling the operation timing of the image forming section.

In the image forming apparatus described in the foregoing, it is desirable that the control section conducts controlling operations for forming the band-shaped toner image in order to consume a constant amount of toner.

In the image forming apparatus described in the foregoing, it is desirable that the control section conducts controlling operations for forming the band-shaped toner image in order to apply a cleaning operation onto the surface of the image bearing member.

In the image forming apparatus described in the foregoing, it is desirable that the control section conducts controlling operations for forming the band-shaped toner image, other than a correction-use patch toner image to be used for correcting an operating condition of the image forming section.

In the image forming apparatus described in the foregoing, it is desirable that the control section employs the timing signal to conduct controlling operations for generating a horizontal valid signal and a vertical valid signal of the band-shaped toner image.

DETAILED DESCRIPTION OF THE INVENTION

Figure 1:
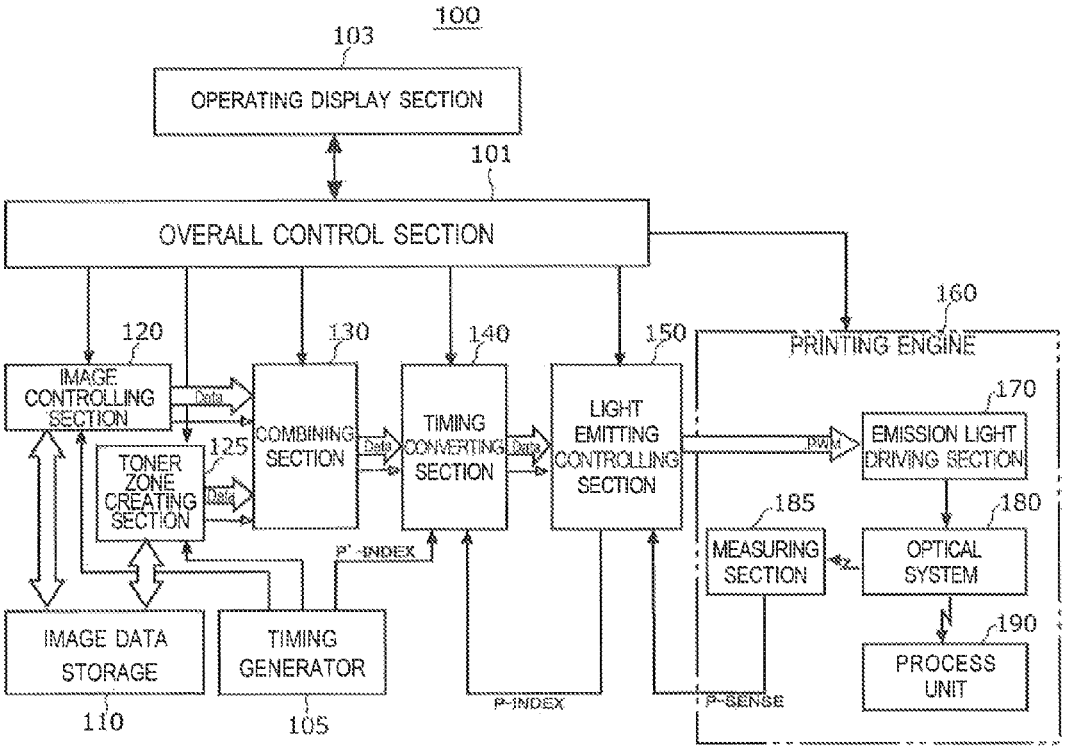
FIG. 1 is a block diagram showing a configuration of an image forming apparatus embodied in the present invention.

Referring to the drawings, an embodiment for implementing the present invention will be detailed in the following.

<Configuration of Image Forming Apparatus>

Referring to the block diagram shown in FIG. 1, the configuration of the image forming apparatus embodied in the present invention will be detailed in the following. The image forming apparatus 100 is constituted by an overall control section 101, an operating display section 103, a timing generator 105, an image data storage 110, an image controlling section 120, a toner zone creating section 125, a combining section 130, a timing converting section 140, a light emitting controlling section 150 and a printing engine 160.

In the above configuration, the overall control section 101 controls each of the sections included in the image forming apparatus 100, as well as overall operations of the image forming apparatus 100. The operating display section 103 notifies the overall control section 101 of inputted operation signals corresponding to inputting operations conducted by an operator, as well as displays the operating statuses of the image forming apparatus 100 thereon. The timing generator 105 generates various kinds of timing signals to be employed by the sections provided within the image forming apparatus 100. The image data storage 110 stores various kinds of image data therein. The image controlling section 120 conducts various kinds of controlling operations in regard to image processing and image data for achieving the image forming operation. The toner zone creating section 125 creates image data representing the band-shaped toner image to be formed on the paper interval area. The combining section 130 receives the image data sent from the image controlling section 120 and the other image data sent from the toner zone creating section 125, and then, outputs them to the subsequent stage. The timing converting section 140 applies a timing conversion processing to both the image data sent from the image controlling section 120 and the other image data sent from the toner zone creating section 125. The light emitting controlling section 150 converts the image data sent from the timing converting section 140 to PWM (Pulse Width Modulation) signals to be employed for modulating the emission light. The printing engine 160 receives the PWM signals based on the image data to form an image on a paper sheet.

In this connection, the printing engine 160 is such a unit that is equivalent to an image forming section, and is constituted by an emission light driving section 170, an optical system 180, a measuring section 185 and a process unit 190. Further, since a mechanical structure of the printing engine 160 is well-known, the explanations for it will be omitted hereinafter. However, any one of various kinds of image forming apparatuses that employ the electro-photographic method may be possibly employed for this purpose.

In the printing engine 160, the emission light driving section 170 makes the light emitting element emit light modulated on the basis of the PWM signals so as to generate a modulated light beam. The optical system 180 includes a polygon mirror and various kinds of lenses to scan the modulated light beam, generated by the emission light driving section 170, onto the surface of the image bearing member in a main-scanning direction. The measuring section 185 receives the modulated light beam, currently scanned in the main-scanning direction, at a predetermined position to acquire a detected result P-SENCE. The process unit 190 forms a toner image from an electrostatic latent image formed on the surface of the image bearing member, which moves in a sub-scanning direction while receiving the modulated light beam scanned in the main-scanning direction, and then, transfers the toner image onto the paper sheet.

EXPLANATIONS OF TECHNICAL TERMS USED IN PRESENT EMBODIMENT

Now, the contents of each of the signals used in the present embodiment will be detailed in the following.

Detected result P-SENCE: This is acquired by receiving a light beam, which is generated by the emission light driving section 170 and reflected by the polygon mirror so as to scan the light beam on the surface of the image bearing member in a main-scanning direction, with the measuring section 185, such as an index sensor (not shown in the drawings), etc., disposed at a position in the vicinity of an edge portion of the image bearing member, and is such a signal that serves as a base of an index signal P-INDEX detailed later.

Index signal P-INDEX: This is an index signal serving as a horizontal synchronizing signal generated by the light emitting controlling section 150 based on the detected result P-SENCE acquired by detecting a light beam, which is reflected by the polygon mirror so as to scan the light beam on the surface of the image bearing member, at a predetermined position, and is used for various kinds of timing control operations, etc.

Timing signal P'-INDEX: This is a timing signal serving as a quasi horizontal synchronizing signal generated by the timing generator 105 in such a manner that, as an alternate signal of the index signal P-INDEX, the period of the timing signal P'-INDEX becomes nearly equal to that of the index signal P-INDEX without depending on the detected result P-SENCE, and is employed for forming the band-shaped toner image within the paper interval area in the present embodiment.

Vertical valid signal V-Valid: In a case where a main-scanning direction of a light beam is defined as a Horizontal direction (H-direction) and a sub-scanning direction being orthogonal to the main-scanning (horizontal) direction is defined as a Vertical direction (V-direction), this signal turns to an active status at a light emission timing of the sub-scanning direction in an area within which the light emitting element, included in the emission light driving section 170, is possibly made to emit light, in order to irradiate the light beam onto the surface of the image bearing member, so as to represent a valid time duration in the Vertical direction with respect to the irradiation of the light beam. In the present embodiment, the Vertical valid signal V-Valid turns to the active status at the light emission timing of the sub-scanning direction in the toner image area within which the toner image based on the image data is possibly formed, and at the other light emission timing of the sub-scanning direction in the paper interval area within which the band-shaped toner image is formed.

Horizontal valid signal H-Valid: This signal turns to an active status at a light emission timing of the main-scanning direction in an area within which the light emitting element, included in the emission light driving section 170, is possibly made to emit light, in order to irradiate the light beam onto the surface of the image bearing member, so as to represent a valid time duration in the Horizontal direction with respect to the irradiation of the light beam. In the present embodiment, the Horizontal valid signal H-Valid turns to the active status at the light emission timing of the main-scanning direction in the toner image area within which the toner image to be transferred onto the paper sheet is possibly formed, and at the other light emission timing of the main-scanning direction in the paper interval area within which the band-shaped toner image is formed.

Toner image area: This is defined as a part of the surface of the image bearing member, within which a toner image to be transferred onto a paper sheet is formable. In this connection, the toner image area does not include another area on which such a toner image that is not to be transferred onto the paper sheet, such as a band-shaped toner image, etc., may be formed.

Paper interval area: This is defined as another part of the surface of the image bearing member, which resides between the toner image area defined in the above and a next toner image area, namely, which resides between two toner image areas, being adjacent to each other, on the surface of the image bearing member.

Incidentally, the term of "index signal P-INDEX" above-defined is referred to as an "index signal based on a detected result of a light beam irradiating operation" or an "index signal" in the claims. While, the term of "timing signal P'-INDEX" above-defined is referred to as a "timing signal generated otherwise without depending on a detected result of a light beam irradiating operation" or a "timing signal" in the claims.

<Detailed Descriptions for Each of Sections Provided in Image Forming Apparatus>

The overall control section 101 also serves as a magnification factor adjusting section that adjust the image magnification factors of obverse and reverse sides of the paper sheet, onto which toner images are to be transferred. Under the controlling actions performed by the overall control section 101, the magnification factor adjusting operation is achieved by finely adjusting the moving velocity of the image bearing member provided in the process unit 190 and/or the rotation number of the polygon mirror provided in the optical system 180.

Further, with respect to the image data sent from the image controlling section 120 and the other image data sent from the toner zone creating section 125, the timing converting section 140 applies optimum timing conversion processing to the image data and the other image data, respectively. Concretely speaking, in the toner image area on the surface of the image bearing member, the timing converting section 140 applies the timing conversion processing to the image data sent from the image controlling section 120, so that the operation timing of the image data to be used for the image forming operation coincides with the index signal P-INDEX based on the detected result P-SENCE acquired by detecting the light beam.

On the other hand, in the paper interval area, the timing converting section 140 applies the timing conversion processing to the other image data sent from the image toner zone creating section 125, so that the operation timing of the other image data coincides with the index signal P'-INDEX created otherwise without depending on the detected result P-SENCE acquired by detecting the light beam. Therefore, the printing engine 160 forms the band-shaped toner image based on the operation timing converted by the timing converting section 140.

In this connection, at the time when adjusting the magnification factor, since the rotational status of the polygon mirror is still unstable, the time intervals between the detected results P-SENCE are non-uniform. As a result, the index signal P-INDEX also becomes unstable. Accordingly, under the controlling operations conducted by the overall control section 101, the timing generator 105 generates otherwise the timing signal P'-INDEX in a stable state, which does not depend on the detected result P-SENCE acquired by irradiating the light beam, but substantially equivalent to the index signal P-INDEX. On that occasion, the timing generator 105 generates the timing signal P'-INDEX, based on information in regard to the period of the index signal P-INDEX and the driving history of the polygon mirror, acquired in so far.

The image controlling section 120 outputs image data to be employed for an image forming operation, and a vertical valid signal V-Valid, etc., corresponding to the image data concerned, to the combining section 130. While the toner zone creating section 125 outputs image data to be employed for forming a bond-shaped toner image, and a vertical valid signal V-Valid, etc., corresponding to the image data concerned, to the combining section 130.

Successively, the combining section 130 outputs the image data to be employed for the image forming operation, and the vertical valid signal V-Valid, etc., or the other image data to be employed for forming the band-shaped toner image, and the vertical valid signal V-Valid, etc., to the timing converting section 140.

Still successively, the timing converting section 140 outputs the image data to be employed for the image forming operation, and the vertical valid signal V-Valid, etc., or the other image data to be employed for forming the band-shaped toner image, and the vertical valid signal V-Valid, etc., to which the timing conversion processing based on the index signal P-INDEX or the timing signal P'-INDEX are applied, to the light emitting controlling section 150.

Referring to the schematic diagram shown in FIG. 2, the band-shaped toner image to be formed within the paper interval area, established on the surface of the image bearing member, will be detailed in the following.

Figure 2:
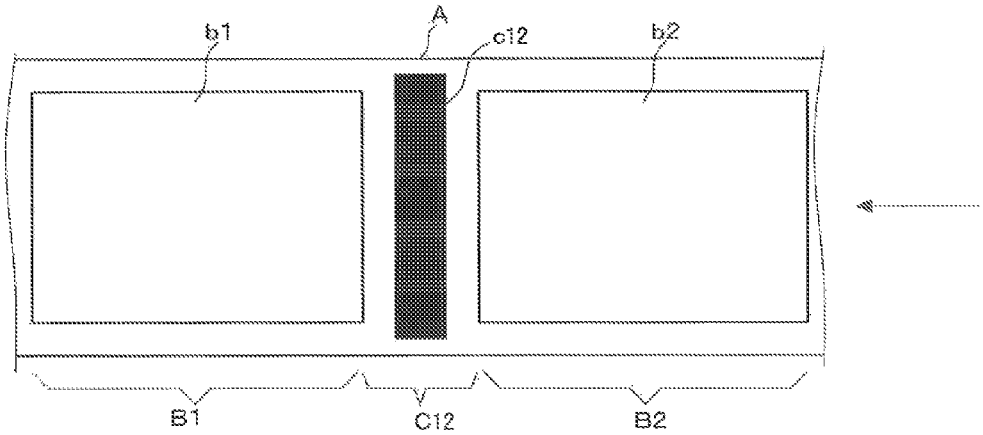
FIG. 2 is an explanatory schematic diagram showing an appearance of a band-shaped toner image to be formed by an image forming apparatus embodied in the present invention.

As shown in FIG. 2, an area A is shown by developing the surface of the image bearing member, such as a photoreceptor drum, an intermediate transfer member, etc. Herein, a toner image area b1, on which a toner image to be transferred onto a paper sheet is formed, resides within an area B1. While, a toner image area b2, on which a toner image to be transferred onto a next paper sheet is formed, resides within an area B2. Further, an area C12 resides between the area B1 and the area B2. A paper interval area c12, on which the band-shaped toner image is to be formed, resides within an area C12.

In this connection, the positions of the toner image area and the paper interval area are not determined in advance as absolute positions on the surface of the image bearing member. Instead, the position of the toner image area is determined eventually at the time when the light beam is irradiated onto the surface of the image bearing member, and then, the position of the patch toner image is determined automatically at a position between the positions of the toner image area and the next toner image area.

By forming such the band-shaped toner image, serving as a solid color image as aforementioned, onto the paper interval area, it is possible to prevent the toner from staying within the developing device for a long time. As a result, it becomes possible to prevent the residual toner remaining within the developing device from deteriorating. Further, by cleaning the band-shaped toner image with the cleaning device after forming it on the surface of the image bearing member, such as a photoreceptor drum, an intermediate transfer member, etc., it becomes possible to uniformly clean the surface thereof, resulting in keeping a good surface condition thereof.

<Operations of Image Forming Apparatus>

Figure 4:
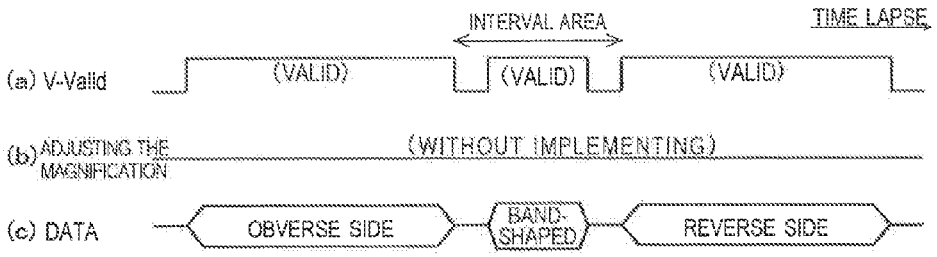
FIG. 4*a*, FIG. 4*b* and FIG. 4*c* are time charts indicating operations to be implemented by an embodiment of the present invention.
Figure 5:
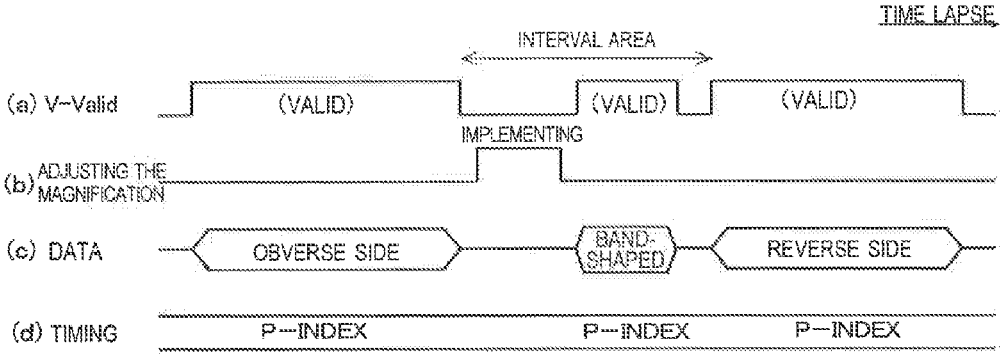
FIG. 5*a*, FIG. 5*b*, FIG. 5*c* and FIG. 5*d* are time charts indicating operations being compared with those to be implemented by an embodiment of the present invention.
Figure 6:
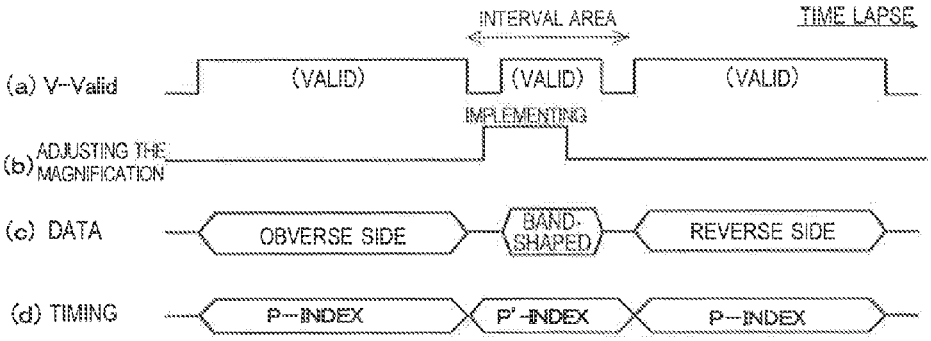
FIG. 6*a*, FIG. 6*b*, FIG. 6*c* and FIG. 6*d* are time charts indicating operations to be implemented by an embodiment of the present invention.

Referring to the flowchart shown in FIG. 3 and the time charts shown in FIG. 4 through FIG. 6, the operations to be conducted in the present embodiment will be detailed in the following.

Figure 3:
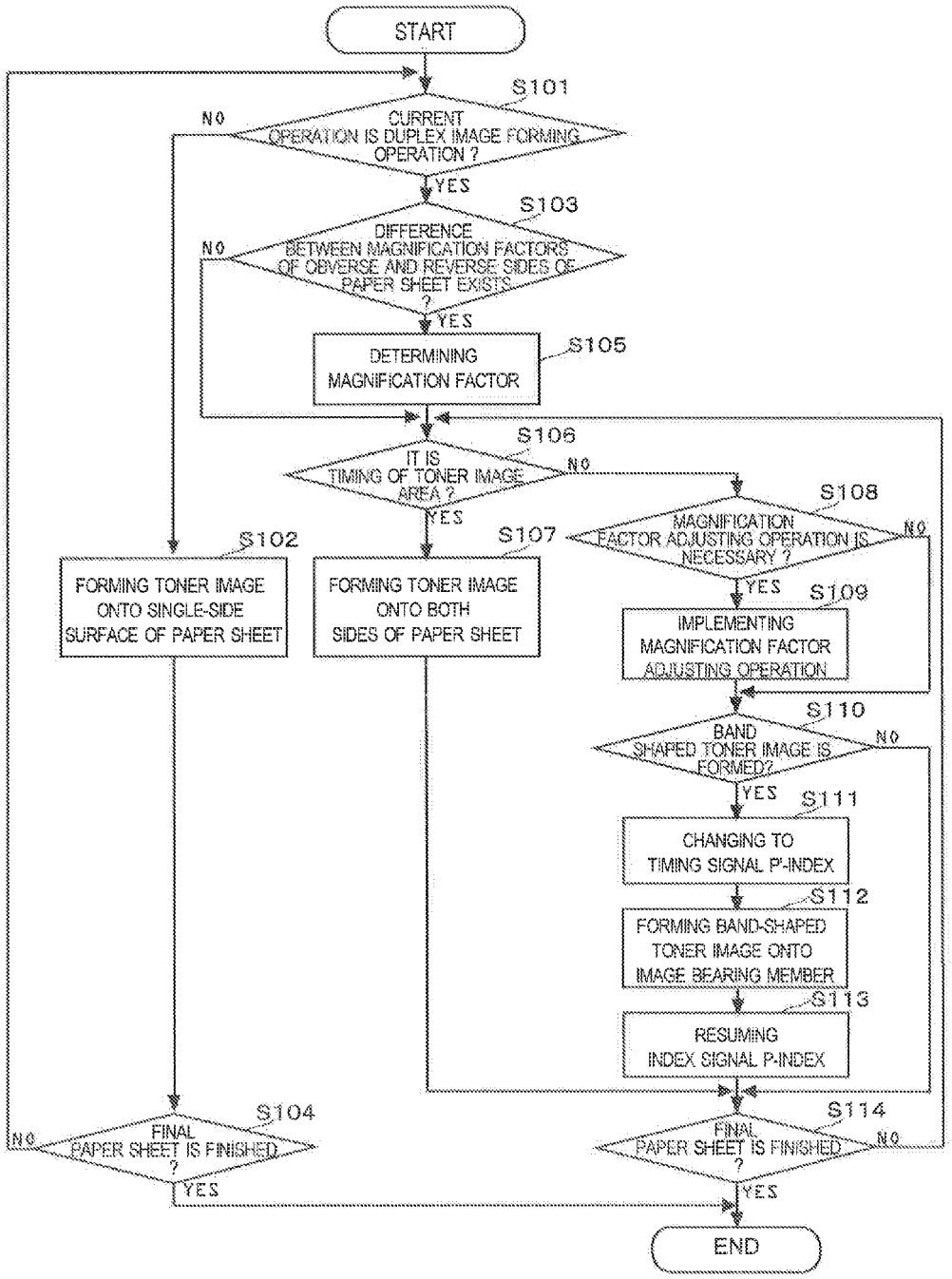
FIG. 3 is a flowchart showing a flow of operations to be conducted in an image forming apparatus embodied in the present invention.

Initially, the overall control section 101 determines whether the image forming operation to be currently implemented is a duplex image forming operation or a single-side image forming operation (Step S101 shown in FIG. 3). When determining as the single-side image forming operation (Step S101 shown in FIG. 3; NO), it is unnecessary to implement the magnification factor adjusting operation. Accordingly, under the controlling operations conducted by the overall control section 101, the operation for forming a normal toner image onto a single-side surface of each of paper sheets is repeatedly implemented, until the image forming operation for the final paper sheet has been completed (Steps S102, S104, shown in FIG. 3).

On the other hand, when determining that the image forming operation to be currently implemented is a duplex image forming operation (Step S101 shown in FIG. 3; YES) the overall control section 101 further determines whether or not a difference between magnification factors of obverse and reverse sides of the paper sheet caused by the fixing operation, etc., exists (In other words, whether or not it is necessary to implement the magnification factor adjusting operation) (Step S103 shown in FIG. 3). When determining that the difference between the magnification factors of obverse and reverse sides of the paper sheet exists (Step S103 shown in FIG. 3; YES), the overall control section 101 determines a magnification factor adjusting value according to various kinds of parameters including a fixing temperature, a kind of paper sheets, a paper-sheet conveyance velocity, etc., (Step S105 shown in FIG. 3).

Successively, in the operation for forming images onto both sides of the paper sheet, wen determining that there arrives at a timing of the toner image area for irradiating the light beam onto the surface of the image bearing member to form a latent image thereon (Step S106 shown in FIG. 3; YES), the overall control section 101 controls the various kinds of concerned sections so as to implement the steps of: forming a latent image onto the toner image area of the surface of the image bearing member; developing the latent image with toner to form a toner image thereon; transferring the toner image to a paper sheet; and fixing the toner image thereon (Step S107 shown in FIG. 3). As mentioned in the above, under the controlling operations conducted by the overall control section 101, the abovementioned operating steps are repeated with respect to both sides of each of the paper sheet until the image forming operation for the final paper sheet has been completed (Steps S107, S114, shown in FIG. 3). In this connection, on the occasion of forming images onto the both sides of the paper sheet, under the instructions issued by the overall control section 101, the timing converting section 140 applies the timing conversion processing to the image data to be used for the duplex image forming operation, with reference to the index signal P-INDEX, generated by the light emitting controlling section 150 based on the detected result P-SENCE outputted from the measuring section 185.

On the other hand, in the operation for forming images onto both sides of the paper sheet, when determining that there arrives at a timing of the paper interval area, other than the timing of the toner image area for irradiating the light beam onto the surface of the image bearing member to form a latent image thereon (Step S106 shown in FIG. 3; NO), and when determining that the magnification factor adjusting operation is necessary (Step S108 shown in FIG. 3; YES), the overall control section 101 implements the magnification factor adjusting operation based on the magnification factor adjusting value determined in Step S105 (Step S109 shown in FIG. 3). In this case, according to the magnification factor adjusting value, the overall control section 101 finely adjusts the driving velocity of the image bearing member disposed in the process unit 190 and the rotation number of the polygon mirror mounted within the optical system 180.

Successively, when it is determined that the band-shaped toner image is formed on the paper interval area of the surface of the image bearing member for the purpose of consuming or cleaning toner (Step S110 shown in FIG. 3; YES), under the instructions issued by the overall control section 101, the timing converting section 140 changes the current timing signal to the timing signal P'-INDEX outputted from the timing generator 105, instead of the index signal P-INDEX based on the detected result P-SENCE outputted from the measuring section 185. Then, the timing converting section 140 applies the timing conversion processing to the image data to be used for forming the band-shaped toner image, with reference to the timing signal P'-INDEX (Step S111 shown in FIG. 3).

Still successively, without waiting the completion of the magnification factor adjusting operation, under the instructions issued by the overall control section 101, various kinds of concerned sections perform the steps of irradiating the light beam onto the paper interval area of the surface of the image bearing member so as to form a latent image based on the image data of the band-shaped toner image, outputted from the toner zone creating section 125; developing the latent image with toner to form the band-shaped toner image on the surface of the image bearing member; transferring the band-shaped toner image onto the intermediate transfer member or the like as needed; and then, removing the toner in the cleaning section (Step S112 shown in FIG. 3).

Herein, even in mid-course of performing the magnification factor adjusting operation, the band-shaped toner image is formed on the basis of the timing signal P'-INDEX being in a stable state without depending on the detected result P-SENCE of the light beam irradiation. Therefore, the operation for forming the band-shaped toner image is not influenced by instability of the rotation period of the polygon mirror, caused by the magnification factor adjusting operation.

When the operation for forming the band-shaped toner image has been completed, under the instructions issued by the overall control section 101, the timing converting section 140 replaces the timing signal P'-INDEX with the index signal P-INDEX so as to resume the index signal P-INDEX based on the detected result P-SENCE outputted from the measuring section 185 (Step S113 shown in FIG. 3).

Yet successively, under the controlling operations conducted by the overall control section 101, returning to the area determining step (Step S106 shown in FIG. 3), the various kinds of concerned sections repeat the aforementioned operations (including: forming a toner image within the toner image area, transferring the toner image onto a paper sheet and forming a band-shaped toner image within the paper interval area) until the operations for the final paper sheet has been completed (Step S114 shown in FIG. 3).

In this connection, the explanations described in the foregoing have been focused on being able to change the timing signal to be used in the timing converting section 140, from the index signal P-INDEX to the timing signal P'-INDEX, when forming the band-shaped toner image in mid-course of implementing the magnification factor adjusting operation in parallel. In addition, since the timing converting section 140 creates or converts the horizontal valid signal H-Valid and the vertical valid signal V-Valid, based on the timing signal P'-INDEX, it becomes possible to normally implement the operation for forming the band-shaped toner image in mid-course of adjusting the image magnification factor in parallel, resulting in reduction of the operating time.

As described in the foregoing, according to the present invention, within the toner image area, the operation timing in the image forming section is controlled by employing the index signal based on the detected result of the light beam irradiation of the image forming section. On the other hand, on such the occasion that the operations for adjusting the image-magnification factor and forming the band-shaped toner image are implemented in parallel within the paper interval area residing between the toner image areas being adjacent to each other on the surface of the image bearing member, the operation timing in the image forming section is controlled by employing the timing signal generated otherwise without depending on the detected result of the light beam irradiation of the image forming section. Therefore, it becomes possible to normally implement the operation for forming the band-shaped toner image in mid-course of adjusting the image magnification factor in parallel, resulting in reduction of the processing time.

Further, in the present embodiment described in the foregoing, in order to consume a constant amount of toner from the toner currently existing in the developing device, it is desirable to form the band-shaped toner image aforementioned. In this way, by forming the band-shaped toner image serving as a solid color image onto the paper interval area, it is possible to prevent the toner from staying within the developing device for a long time. As a result, it becomes possible to prevent the residual toner remaining within the developing device from deteriorating. In addition, by normally implementing the operation for forming the band-shaped toner image in mid-course of adjusting the image magnification factor in parallel, it also becomes possible to shorten the operating time thereof while preventing the toner from staying within the developing device for a long time and deteriorating.

Still further, in the present embodiment described in the foregoing, in order to clean the surface of the image bearing member, the intermediate transfer member or the like, it is desirable to form the band-shaped toner image. Concretely speaking, by performing the cleaning operation in the cleaning section after the band-shaped toner image is formed, the surface of the image bearing member, the intermediate transfer member or the like may be uniformly maintained at a good condition.

Still further, in the present embodiment described in the foregoing, under the controlling operations, the horizontal valid signal and the vertical valid signal are generated in mid-course of adjusting the image magnification factor by employing the timing signal created otherwise without depending on the detected result of the light beam irradiation. Accordingly, by normally implementing the operation for forming the band-shaped toner image in mid-course of adjusting the image magnification factor in parallel, it becomes possible to shorten the operating time thereof.

Still further, since the band-shaped toner image aforementioned is formed on the basis of the timing signal P'-INDEX created otherwise by the timing generator 105, sometimes, the rigorous positioning may be difficult. For this reason, it is not desirable to form a patch toner image, which should be positioned at such a position that corresponds to that of the reading sensor. Accordingly, it is desirable to form such a toner image that does not require a strict controlling operation with respect to its position, other than the patch toner image as abovementioned. In other words, the controlling operations are conducted so as to form the band-shaped toner image, other than the patch toner image to be used for correcting the operating condition of the image forming section, in mid-course of adjusting the image magnification factor. Accordingly, by normally implementing the operation for forming the band-shaped toner image in mid-course of adjusting the image magnification factor in parallel, it becomes possible to shorten the operating time thereof.

However, by making the area of the patch toner image being sufficiently larger than the light receiving area of the sensor, it may be possible to form the patch toner image to be used for various kinds of adjusting purposes, as the band-shaped toner image aforementioned.

Verification of Effects of Present Embodiment

Referring to the time charts, the effects of the present embodiment will be detailed in the following.

FIG. 4*a* through FIG. 4*c* are time charts showing such a state that the duplex image forming operation is conducted to form the bond-shaped toner image within the paper interval area without performing the magnification factor adjusting operation. Herein, the time chart shown in FIG. 4*a* indicates the vertical valid signal V-Valid in a sub-scanning direction when performing the image forming operation based on the image data. The time chart shown in FIG. 4*b* indicates a state without implementing the magnification factor adjusting operation. Further, the time chart shown in FIG. 4*c* indicates a sequence of image data representing an image to be formed on the obverse side of the paper sheet, image data representing the band-shaped toner image and image data representing an image to be formed on the reverse side of the paper sheet.

FIG. 5*a* through FIG. 5*d* are time charts showing such a state that the duplex image forming operation is conducted by employing a conventional method in which the operations for adjusting the magnification factor and forming the band-shaped toner image are implemented during the time interval of the paper interval area. Herein, the time chart shown in FIG. 5*a* indicates the vertical valid signal V-Valid in a sub-scanning direction when performing the image forming operation based on the image data. The time chart shown in FIG. 5*b* indicates timing for implementing the magnification factor adjusting operation. The time chart shown in FIG. 5*c* indicates a sequence of image data representing an image to be formed on the obverse side of the paper sheet, image data representing the band-shaped toner image and image data representing an image to be formed on the reverse side of the paper sheet. Further, the time chart shown in FIG. 5*d* indicates a sequence of timing signals with which the current image data is in conformity. In this case, since the index signal P-INDEX becomes unstable at the time of adjusting the magnification factor, times for adjusting the magnification factor and forming the bend-shaped toner image are shifted from each other so as to securely perform the operation for forming the band-shaped toner image. For this reason, it is necessary to widen the paper interval area wider than that shown in FIG. 4*a*, and there arises such a problem that the productivity (number of paper sheets to be outputted per unit time) may be deteriorated.

FIG. 6*a* through FIG. 6*d* are time charts showing such a state that the duplex image forming operation is conducted according to the method of the present embodiment in which the operations for adjusting the magnification factor and forming the band-shaped toner image are implemented during the time interval of the paper interval area. Herein, the time chart shown in FIG. 6*a* indicates the vertical valid signal V-Valid in a sub-scanning direction when performing the image forming operation based on the image data. The time chart shown in FIG. 6*b* indicates timing for implementing the magnification factor adjusting operation. The time chart shown in FIG. 5*c* indicates a sequence of image data representing an image to be formed on the obverse side of the paper sheet, image data representing the band-shaped toner image and image data representing an image to be formed on the reverse side of the paper sheet. Further, the time chart shown in FIG. 6*d* indicates a sequence of timing signals with which the current image data is in conformity.

In this case, considering that the index signal P-INDEX becomes unstable at the time of adjusting the magnification factor, the operation for forming the band-shaped toner image is implemented by changing the timing signal to the timing signal P'-INDEX, so as to securely perform the operations for adjusting the magnification factor and forming the bend-shaped toner image, even if both the operations are implemented in parallel. Accordingly, in the case of the controlling operations shown in FIGS. 6*a* through 6*d*, it becomes possible to narrow the paper interval area narrower than that shown in FIGS. 5*a* through 5*d*. Therefore, according to the controlling operations shown in FIGS. 6*a* through 6*d*, the paper interval area substantially equivalent to that in the controlling operations shown in FIGS. 4*a* through 4*c* may be left as it is, and both the operations for adjusting the magnification factors of obverse and reverse sides of the paper sheet and forming the band-shaped toner image within the paper interval area can be implemented in a short time without deteriorating the productivity (number of paper sheets to be outputted per unit time).

Other Embodiments

The explanations described in the foregoing have been focused on being able to change the timing signal to be used in the timing converting section 140, from the index signal P-INDEX to the timing signal P'-INDEX, when forming the band-shaped toner image in mid-course of implementing the magnification factor adjusting operation in parallel. However, the scope of the present invention is not limited to the aforementioned embodiment.

For instance, the image forming apparatus 100 may be so constituted that, based on the timing signal P'-INDEX, the toner zone creating section 125 creates the image data representing the band-shaped toner image, the horizontal valid signal H-Valid and the vertical valid signal V-Valid, in advance, and on an occasion of forming the band-shaped toner image in mid-course of implementing the magnification factor adjusting operation, the various kinds of data and signals created in advance in the toner zone creating section 125 are directly outputted to the light emitting controlling section 150 without passing through the timing converting section 140. In this case, a separate signal path, through which the data and signals sent from the toner zone creating section 125 arrive at the light emitting controlling section 150 without passing through the timing converting section 140, or the signal path switching circuit or the like may be installed therein.

Further, although, according to the explanations in the foregoing, the timing generator 105 generates the timing signal P'-INDEX, the scope of the present invention is not limited to the above. For instance, the image forming apparatus

100 may be so constituted that the overall control section 101 creates the timing signal P'-INDEX so as to distribute the timing signal P'-INDEX to the sections concerned.

The present U.S. patent application claims a priority under the Paris Convention of Japanese patent application No. 2012-161548 filed on Jul. 20, 2012, which shall be a basis of correction of an incorrect translation.

What is claimed is:

1. An image forming apparatus, comprising an image forming section configured to perform operations for irradiating a light beam onto a surface of an image bearing member, forming a toner image corresponding to electrostatic potential changes caused by the light beam and transferring the toner image onto a paper sheet;

a control section configured to control the image forming section; and a magnification factor adjusting section configured to adjust image magnification factors of obverse and reverse sides of the paper sheet;

wherein the control section conducts controlling operations so as to form a band-shaped toner image on an area located between toner image areas, which reside on the surface of the image bearing member and are adjacent to each other, and the control section employs an index signal based on a detected result of a light beam irradiation, for controlling an operation timing of the image forming section in the toner image area; and wherein, when forming the band-shaped toner image on the area between the toner image areas being adjacent to each other, while controlling the magnification factor adjusting section to implement an operation for adjusting the image magnification factors in parallel, the control section employs a timing signal, created otherwise without depending on the detected result of the light beam irradiation, for controlling the operation timing of the image forming section, and wherein the operation timing controlled by the timing signal is shorter than the operation timing controlled by the index signal.

2. The image forming apparatus of claim 1, wherein the control section conducts controlling operations for forming the band-shaped toner image in order to consume a constant amount of toner.

3. The image forming apparatus of claim 1, wherein the control section conducts controlling operations for forming the band-shaped toner image in order to apply a cleaning operation onto the surface of the image bearing member.

4. The image forming apparatus of claim 1, wherein the control section conducts controlling operations for forming the band-shaped toner image, other than a correction-use patch toner image to be used for correcting an operating condition of the image forming section.

5. The image forming apparatus of claim 1, wherein the control section employs the timing signal to conduct controlling operations for generating a horizontal valid signal and a vertical valid signal of the band-shaped toner image.

* * * * *